United States Patent [19]

Saville

[11] Patent Number: 4,685,963

[45] **Date of Patent: * Aug. 11, 1987**

[54] PROCESS FOR THE EXTRACTION OF PLATINUM GROUP METALS

[75] Inventor: James Saville, Anniston, Ala.

[73] Assignee: Texasgulf Minerals and Metals, Inc., Anniston, Ala.

[ * ] Notice: The portion of the term of this patent subsequent to Oct. 20, 1998 has been disclaimed.

[21] Appl. No.: 621,572

[22] Filed: Jun. 18, 1984

Related U.S. Application Data

[63] Continuation-in-part of Ser. No. 259,883, May 4, 1981, abandoned, which is a continuation of Ser. No. 158,184, Jun. 10, 1980, Pat. No. 4,295,881, which is a continuation of Ser. No. 38,820, May 14, 1979, abandoned, which is a continuation-in-part of Ser. No. 32,680, Apr. 23, 1979, abandoned.

[30] Foreign Application Priority Data

May 22, 1978 [ZA] South Africa ..... 78/2907

[51] Int. Cl.[4] ..... C22B 11/00

[52] U.S. Cl. ..... 75/10.19; 75/83

[58] Field of Search ..... 75/10 R, 83, 10.19

[56] References Cited

U.S. PATENT DOCUMENTS

| | | | |
|---|---|---|---|
| 1,841,207 | 1/1932 | Powell et al. | 75/83 |
| 3,304,169 | 2/1967 | Death et al. | 75/83 |
| 3,783,167 | 1/1974 | Tylko | 75/10.19 |
| 3,920,789 | 11/1975 | Pittie et al. | 75/121 |
| 4,135,923 | 1/1979 | Day | 75/83 |
| 4,188,362 | 2/1980 | Edwards | 75/121 |
| 4,295,881 | 10/1981 | Saville | 75/83 |

FOREIGN PATENT DOCUMENTS

| | | | |
|---|---|---|---|
| 7802907 | 9/1979 | South Africa . | |
| 328564 | 4/1930 | United Kingdom | 75/83 |
| 1481295 | 7/1977 | United Kingdom | 75/83 |

*Primary Examiner*—Melvyn J. Andrews

*Attorney, Agent, or Firm*—Kenyon & Kenyon

[57] ABSTRACT

A process for separating platinum group metals (PGM's) from various feedstock materials, is disclosed, wherein a plasma arc flame is employed to produce a superheated puddle on the surface of a slag layer to accelerate the association of platinum group metals with a collector material and formation of a recoverable layer of platinum group metals and collector material.

4 Claims, 6 Drawing Figures

PROCESS FOR THE EXTRACTION OF PLATINUM GROUP METALS

This application is a continuation-in-part of application Ser. No. 259,883, filed May 4, 1981 now abandoned which was a continuation of application Ser. No. 158,184, filed June 10, 1980, now U.S. Pat. No. 4,295,881; which was a continuation of application Ser. No. 38,820, filed May 14, 1979, abandoned; which was a continuation-in-part of application Ser. No. 32,680, filed Apr. 23, 1979, abandoned.

BACKGROUND OF THE INVENTION

This invention relates to the separation of platinum group metals from various feedstock materials in a form suitable for further separation and purification.

Prior art pyrometallurgical methods for recovery of platinum group metals, sometimes referred to herein as "PGM's", from various feedstock materials by concentrating them in collector metals have not given entirely satisfactory results—in part—due to the long periods of time (residence time) required for the PGM's to accumulate in the collector metal and separate into a recoverable layer. This necessitates providing a multiplicity of sizes and types of furnaces for treatment of various feedstock materials.

For example, in processes employing electric arc furnaces the slag is heated by passing an electric current between submerged electrodes, through molten slag causing localized heating and temperature gradients which result in significant viscosity gradients in the melt. Higher slag viscosity impedes aggregation and settling of very fine particles of PGM's and collector metals as well as movement of the slag and thus slows the formation of a recoverable layer of PGM's associated with collector metal.

Another disadvantage of prior art processes for recovery of PGM's from finely divided material is a frequent requirement for pre-processing of the feedstock materials into forms that facilitate separation of the PGM's e.g. pelletization. As is well known in the art, pelletization involves comminution and mixing the feedstock material with appropriate fluxes, collector metals, binder and the like, and processing the mixture into larger particles of sufficient size and mass so that they form an open-structured layer on the slag surface and are carried, relatively intact, to the heating zone of whatever furnace is being used. Thus problems associated with segregation of the melt constituents and escape of reaction gases are avoided.

Another disadvantage of prior art proceseses is low tolerance for treating different types of feedstock material.

An exemplary feedstock material is PGM concentrates produced from chromite-bearing ore by processes including comminution, magnetic separation mineral dressing, flotation, and the like. The PGM's which include platinum, palladium, rhodium, ruthenium, iridium and osmium, are sometimes found in association with chromite-bearing ores at chromite grain boundaries, within chromite grains or in the gangue material associated with the ore and they are usually also associated with sulphides of nickel, copper and iron. Extensive deposits of platinum group metals associated with chromite bearing ores exist in the Republic of South Africa and the U.S.A., in particular, the Stillwater Complex in Montana. Of course, the many industrial forms of PGM's results in a large number of additional feedstock materials, other than ores, in which they may be found. Therefore, a versatile process that can recover PGM's from a variety of different feedstock materials, economically and efficiently, is very desirable. Typically, chromite occurs as stratiform or podiform deposits associated with ultramafic igneous rocks. PGM's are of significant industrial value finding application, for example, as catalytic or inert materials in many chemical reactions. They are used extensively in the petroleum industry as catalysts, in the making of dies for the manufacture of fiberglass, in the electrical industry for switch contacts, and for treating automotive exhaust gases in catalytic converters to render harmless oxides of nitrogen, carbon and sulphur. Other uses are for dental devices and jewelry. The major commercial production of platinum group metals from ores is limited to the Republic of South Africa, U.S.S.R., and Canada although there are recycling, purifying and fabricating facilities in many countries.

A traditional method for extracting platinum group metals from ores containing little or no chromite, such as the Merensky Reef ore in the Republic of South Africa, consists of comminution and flotation to produce a concentrate containing platinum group metals and sulphides of nickel, copper and iron. The concentrate is smelted in a continuous process with an average residence time of several hours in a submerged arc, carbon electrode furnace to form a metal matte, to which the platinum group metals report, and slag. The iron and sulphur in the matte are subsequently removed in a separate process step consisting of an air blast converter to which silica is added for reaction with the iron to form a fayalite slag. The slag is recycled in liquid form to the electric arc furnace for reheating and recovery of any entrained particles containing platinum group metals and ultimate discharge from the electric arc furnace as waste. The product from the converter is granulated and treated electrolytically to separate the nickel and copper and to produce a residue containing PGM's in a form suitable for separation and purification of the individual platinum group metals.

It has been found that if chromite-bearing ore containing platinum group metals is treated by this method, the residual chromite particles in the PGM feedstock interfere with the process steps and cause losses of platinum group metals and undesirable accretions in the furnace. It appears that chromite reacts with the carbon electrode material in electric arc furnaces to form ferrochrome which alloys with the platinum group metals and from which the platinum group metals cannot be readily extracted. In addition, chromite particles remote from the electrodes appear to settle out on the furnace walls and hearth forming the above-mentioned undesirable accretions which interfere with smooth operation of the furnace.

SUMMARY OF THE INVENTION

It is an object of the present invention to provide a PGM recovery process wherein a recoverable layer including collector metal and PGM's is rapidly formed, preferably within a few minutes, to reduce furnace residence time for various feedstock materials.

It is another object of the present invention to provide a process that can efficiently recover PGM's from a variety of feedstock materials and that does not require extensive pre-processing of the feedstock materials.

It is another object of the present invention to describe a versatile process for recovery of PGM's from various feedstock materials.

A further object of the invention is to describe a process for the treatment of chromite-bearing ores to recover platinum group metals therefrom. In the course of this description a process is described for recovery of nickel, copper and cobalt from the ore if these metals or minerals thereof occur together with platinum group metals.

These and other objects are achieved by the provision of a process which comprises the steps of:

introducing a charge of flux, a collector material, and a feedstock material including PGM's to a furnace;

forming a melt by heating the charge to at least 1350° C., the melt comprising a first layer of slag and a second layer of collector material associated with a majority of the PGM's from the feedstock material; and impinging a plasma arc on a surface of slag layer so that a superheated puddle is formed on said surface whereby the mixing and formation of the second layer is accelerated.

The superheated puddle is a hot region at the surface of the slag layer where a plasma arc flame, typically at a temperature of about 5,000° to 10,000° C., contacts the slag surface when the source of the flame, a plasma torch, is positioned close to the surface but not so close as to cause premature failure of the plasma torch. The superheated puddle is preferably about 100° to 500° C. hotter than the melt. In the region of the superheated puddle, mixing action caused by both thermal flow, due to temperature gradients, and fluid flow, due to the force of the plasma flame striking the slag surface is believed to be responsible for the very rapid association of PGM's with the collector metal and rapid settling of the PGM's associated with the collector metal into the separate recoverable second layer.

The very rapid association and settling of PGM's and collector metals out of the slag into recoverable second layer enables a continuous process wherein feedstock material can be continually fed to a superheated puddle where PGM's are removed from the feedstock at rates neither possible nor expected with prior art systems.

In accordance with an embodiment of the present invention, a process for recovery of PGM's from chromite ores is described wherein, inter alia, a magnetic fraction resulting from wet high intensity magnetic separation is treated to recover platinum group metals which may be associated therewith. The process comprises the steps of: comminuting the chromite-bearing ore containing one or more platinum group metals associated therewith; subjecting the comminuted ore to single or multiple stage wet high intensity magnetic separation to form separate magnetic and nonmagnetic fractions wherein the nonmagnetic fraction contains a substantial portion of the platinum group metals contained in the ore; subjecting the magnetic fraction, which contains a substantial portion of the chromite contained in the ore, to gravity separation in a flowsheet incorporating comminution and reseparation of composite particles of chromite and gangue and subjecting the tailings to either comminution and flotation of the sulphides of iron and other magnetic sulphides with which the platinum group metals may be associated, or comminution and further gravity concentration of the platinum group metals particles, or subjecting the tailings to wet high intensity magnetic separation in order to separate residual chromite in the tailings from the nonmagnetics; adding these nonmagnetics to the nonmagnetics produced from the original ore; subjecting the combined nonmagnetics product or nonmagnetics from original ore to which has been added flotation or gravity concentrates produced from the aforesaid tailings resulting from gravity separation of the chromite magnetics to comminution and a flotation process to form a concentrate containing inter alia platinum group metals or compounds thereof; adding collector materials for the platinum group metals, activators to improve the collection efficiency and appropriate fluxes; and smelting these materials and concentrates in a high intensity heating furnace to form a slag layer and a layer consisting of the collector material, platinum group metals and nickel, copper and cobalt if they were present in the concentrates smelted in the furnace; removing the liquid slag and collector material together or separately from the furnace; separating the collector material layer from the slag layer and cooling the collector material and slag; separating the platinum group metals and nickel, copper and cobalt, if present, from the collector material by leaching it with a mineral acid followed by separation from the leach solution of nickel, copper and cobalt and also the collector material if it is economically justified, with the platinum group metals forming an insoluble residue or gel within the leaching vessel; separating and refining the individual platinum group metals from the residue or gel by well-known industrial methods; subjecting the slag comminution and separation of metal particles, if it is found that recovery of entrained particles is economically justified, and adding the metal particles to the collector materials, activators, fluxes and concentrates before smelting or else adding the metal particles to the leaching vessel used for separating the platinum group metals from the collector material and other metals present in the ore.

DETAILED DESCRIPTION OF THE INVENTION

Figure 1:
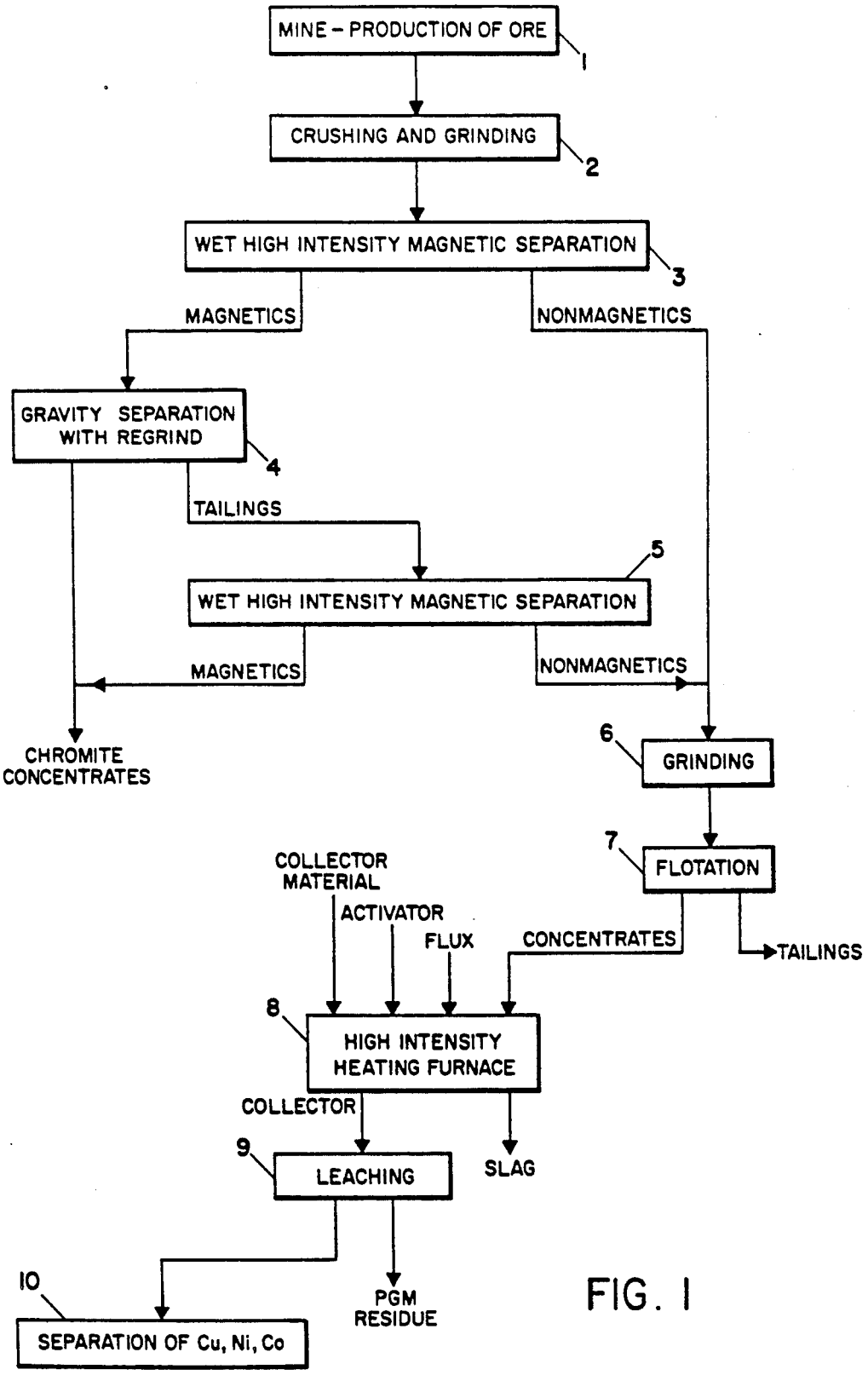
FIG. 1 is a schematic flowsheet of an overall process of the present invention wherein platinum group metals and chromite are recovered from chromite bearing ore.

With reference to FIG. 1, chromite bearing ore containing platinum group metals is mined at 1 by suitable methods and is comminuted at 2 to a sizing suitable for liberation of the chromite grains from gangue and additionally suitable for the magnetic separation which follows. For example, a South African ore was crushed and ground using a conventional ball mill circuit with recirculation of oversize particles to a sizing whereby substantially all of the particles of the ore were able to pass through a 60 mesh ASTM (250μ) screen. A typical sizing for the ground ore was as follows:

| Screen Sizing | | Sizing Distribution |
|---|---|---|
| Mesh ASTM | Microns | Weight % Passing |
| 60 | 250 | 100 |
| 100 | 150 | 77 |
| 140 | 105 | 47 |
| 200 | 74 | 34 |
| 400 | 37 | 16 |

The comminuted ore is then subjected to wet high intensity magnetic separation at 3 in order to separate the magnetic chromite particles from the nonmagnetic gangue particles which contain a substantial portion of the platinum group metals in the ore. In the wet high intensity magnetic separation process a thoroughly mixed slurry of the comminuted ore and water is subjected to a magnetic flux while the slurry is passing through a vessel containing metallic media such as grooved plates, steel wool or balls shaped to intensify the magnetic flux perpendicular to the flow direction of the slurry. The magnetic particles, chromite, are retained on the media and the nonmagnetic gangue particles pass through the vessel. Intermittently the flow of slurry to the vessel is stopped, the magnetic material adhering to the media is washed to remove entrained nonmagnetics and weakly magnetic particles and then the magnetic field is removed, permitting the magnetic particles to be washed from the media. The magnetic field is restored and the slurry is again passed through the vessel in the same series of steps. This intermittent cycle is conveniently automated by fabricating the vessels as annular segments of a ring which rotates continuously perpendicular to fixed electromagnets located around the periphery of the ring.

Depending upon the nature of the ore, one or more passes of magnetics or nonmagnetics through the magnetic field may be necessary to obtain high efficiency of separation. The wash water which contains weakly magnetic particles may be recirculated. For a South African ore, using slurry pulp densities of 10 to 30% solids by weight, two passes of nonmagnetics plus wash water were necessary as shown in 21 and 22 of FIG. 3 with different plate spacings for the first and second pass. In this case, the weight recovery of magnetics was between 75 and 80% with chromium recovery to magnetics of 95 to 97% by weight. The recovery of platinum group metals to nonmagnetics was 65 to 70% by weight.

The distribution of platinum group metals between the magnetics and nonmagnetics fraction is, to a large extent, dependent upon the mineralogy of the platinum group metals in the ore. For example, in a South African ore, about 10% of the platinum group metals particles were locked inside chromite particles and about 90% of the particles were located in the gangue, where they were found sometimes at chromite grain boundaries and often associated with nickel and copper sulphides. The platinum group metal particles may be magnetic, such as iron bearing platinum.

Figure 3:
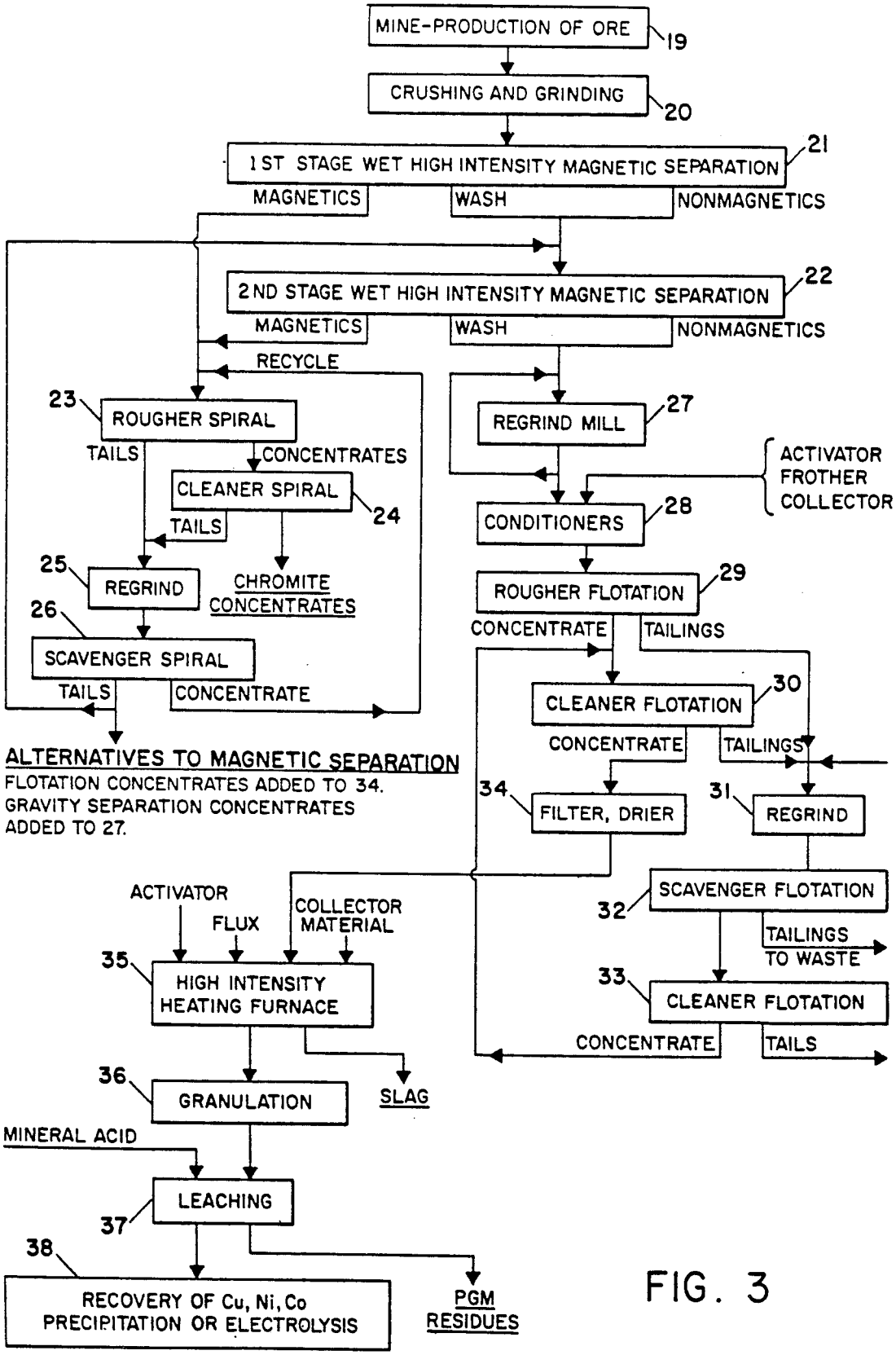
FIG. 3 is a schematic flowsheet of a method used for processing of a South African chromite-bearing ore containing platinum group metals in order to produce chromite concentrates, residues containing platinum group metals and nickel, copper and cobalt as metals or compounds suitable for further purification processes. Three alternative methods for treatment of magnetic product after upgrading by spirals are indicated with the tailings being returned to different locations in the flowsheet.

In order to obtain a higher recovery of platinum group metals from the ore, the magnetics product may be processed further by gravity separation methods at 4 in FIG. 1. It has been found advantageous when processing a South African ore to pass the magnetics product through a spirals gravity separation circuit consisting of a rougher stage at 23 in FIG. 3, one or more cleaner stages at 24 and a scavenger stage 26 for rougher and cleaner tails with a regrind stage at 25 before the scavenger. The scavenger concentrate returns to the rougher feed for reprocessing. The scavenger tails, which contain a considerable portion of the platinum group metals reporting to the magnetics product, may be further processed for concentration of platinum group metals by means of flotation, wet high intensity magnetic separation for removal of residual chromite particles, or by gravity methods such as tabling. In the case of wet high intensity magnetic separation, the tailings material may be added to the feed to the second stage of magnetic separation as shown in FIG. 3.

The nonmagnetic product from 3 in FIG. 1, together with nonmagnetics product from gravity concentration of magnetics product at 5 in FIG. 1, if that is the method used to upgrade the gravity tailings, contains a substantial portion of the platinum group metals present in the ore. This material is subjected to a flotation process 7 in FIG. 1, designed to separate sulphides from the gangue material, thus further concentrating the platinum group metals present as sulphides, or associated with sulphides of copper and nickel and iron.

Depending upon the degree of sub-division of the nonmagnetic product from the magnetic separator, it may be necessary to grind the nonmagnetic product at 6 before flotation in order to achieve rapid and efficient flotation. For a South African ore the optimum sizing for flotation was found to be such that about 80% of the particles pass through a 200 mesh ASTM (74μ) screen.

The flotation circuit may be any such circuit suitably designed and optimized for upgrading such materials, including subjecting the nonmagnetic fraction to a series of flotations in rougher, cleaner, recleaner and scavenger cell banks with the addition of suitable conditioners and pH modifiers such as copper sulphate, sulphuric acid, sodium hydroxide, frothers such as cresylic acid, Flotanol F, and collectors such as sodium isobutyl xanthate.

A typical flotation flowsheet is shown in FIG. 3. The subdivided nonmagnetic fraction is reground at grinding mill 27 in closed circuit with a particle size separation device such as a hydrocyclone, spiral screw classifier or screen, in order to achieve a particle size distribution adequate to liberate the sulphide and platinum group metals particles. The particles which are coarser than the desired sizing are returned to the feed and routed to the mill for regrinding.

It may be advantageous to deslime the slurry produced by the mill before sending it to flotation. A South African ore was deslimed at about 10 microns using hydrocyclones and thus enhanced the recovery of platinum group metals in subsequent flotation of the deslimed ore. Recovery of about 80% to 90% of platinum group metals in the deslimed ore was achieved by flotation. The slimes may contain a considerable portion of the platinum group metals in the nonmagnetics feed to the grinding mill 27. For a South African ore, about 18% of the ground ore was removed as minus 10 micron slimes and this slime contained about 15% of the platinum group metals in the feed to the desliming hydrocyclone. Consequently, the slime should be recovered for smelting by thickening and spray drying of the thickened slimes and blending it with flotation concentrates produced from the deslimed nonmagnetics.

The pulp density of the slurry of suitably sized particles is adjusted to a density suitable for effective mixing and conditioning of the particles with the flotation reagents, conditioners, frothers, collectors previously described and after further density adjustment to the optimum value for flotation it is subjected to flotation in the bank of rougher cells 29. The concentrate from this bank of cells is thereafter admitted to a bank of cleaner cells 30 for final concentration. The tailings material, which is depleted in content of platinum group metals, is densified and sent to a regrind mill 31 which may be operated in open circuit without particle size control, in order to liberate composite particles in which the platinum group metals, sulphides and gangue are intergrown. A typical sizing of product from the regrind mill is 100% less than 200 mesh ASTM (74$\mu$).

The pulp density of the product from the regrind mill is adjusted to the optimum value for flotation and additional reagents, such as frothers and collectors, may be added before scavenger flotation at 32. The concentrate from the scavenger cells is sent to a bank of cleaner cells 33 for further upgrading. The tailings from the scavenger flotation cells is discharged to a tailings pond for recovery and recirculation of water.

The concentrate from cleaner cells 33 is sent to mix with the concentrate produced from rougher cells 29 before refloating in the cleaning flotation cells at 30. The tailings from cleaner cells 33 and cleaner cells 30 are sent to join the tailings from rougher cells 29 before regrinding at 31.

The final concentrate from cleaner flotation cells 30, which contains a substantial portion of the platinum group metals in the nonmagnetics fraction, is then filtered and dried at 34 before smelting at 8 in FIG. 1 and 35 in FIG. 3.

Figure 2:
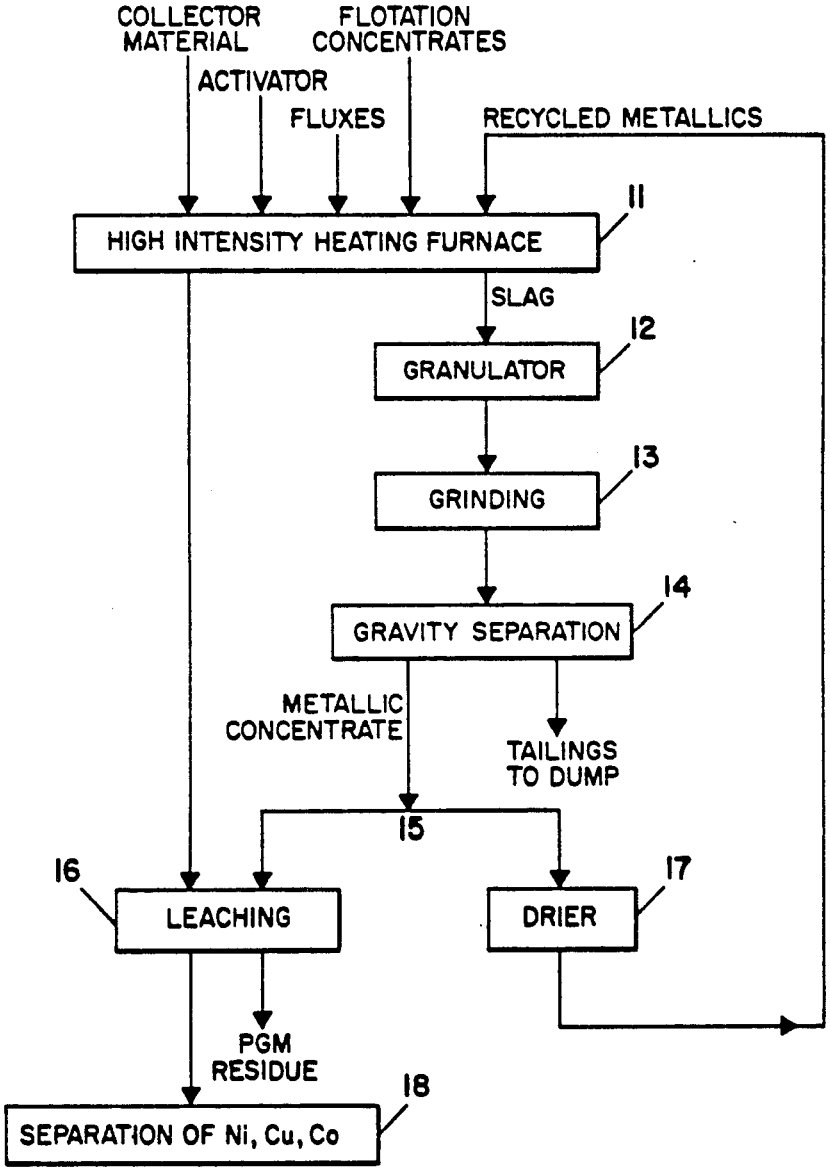
FIG. 2 is a schematic flowsheet of alternative methods of processing the slag from the high intensity heating furnace if this appears to be economically justified, i.e., leaching it together with the collector material or drying it and recycling it to the furnace for remelting.

The purpose of smelting the flotation concentrates in the high intensity heating furnace 11, shown in FIG. 2, together with fluxes, collector material and activator, is to produce a metal layer comprised of platinum group metals and a collector or collectors therefor and a slag layer comprised of residual materials from the flotation concentrates, slimes and fluxes added to produce a fluid slag with a low melting point.

A preferred high intensity heating furnace is a plasma arc furnace, for example, using an expanded precessive plasma arc apparatus manufactured by Tetronics Research and Development Co. (see, for example, U.S. Pat. No. Re. 28,570 of Oct. 14, 1975). In such furnaces, one or more of such plasma devices are utilized to melt powdered feed materials containing platinum group metal concentrates and appropriate powdered collectors, fluxes and other reagents to obtain separate fluid slag and metallic layers which may be separately removed from the furnace.

An important feature of the present invention is the discovery that the process described herein is much less sensitive to the presence of chromite in the heating furnace than is the case with known smelting techniques for the extraction of platinum group metals from ores. In these techniques the presence of as little as 1.0% by weight of chromite in the concentrate fed to the submerged arc carbon electrode furnace, in the known method earlier described, can cause problems with recovery of platinum group metals. The process of the present invention can tolerate at least 7% chromite in the feed to the heating furnace without encountering such difficulties.

Figure 6:
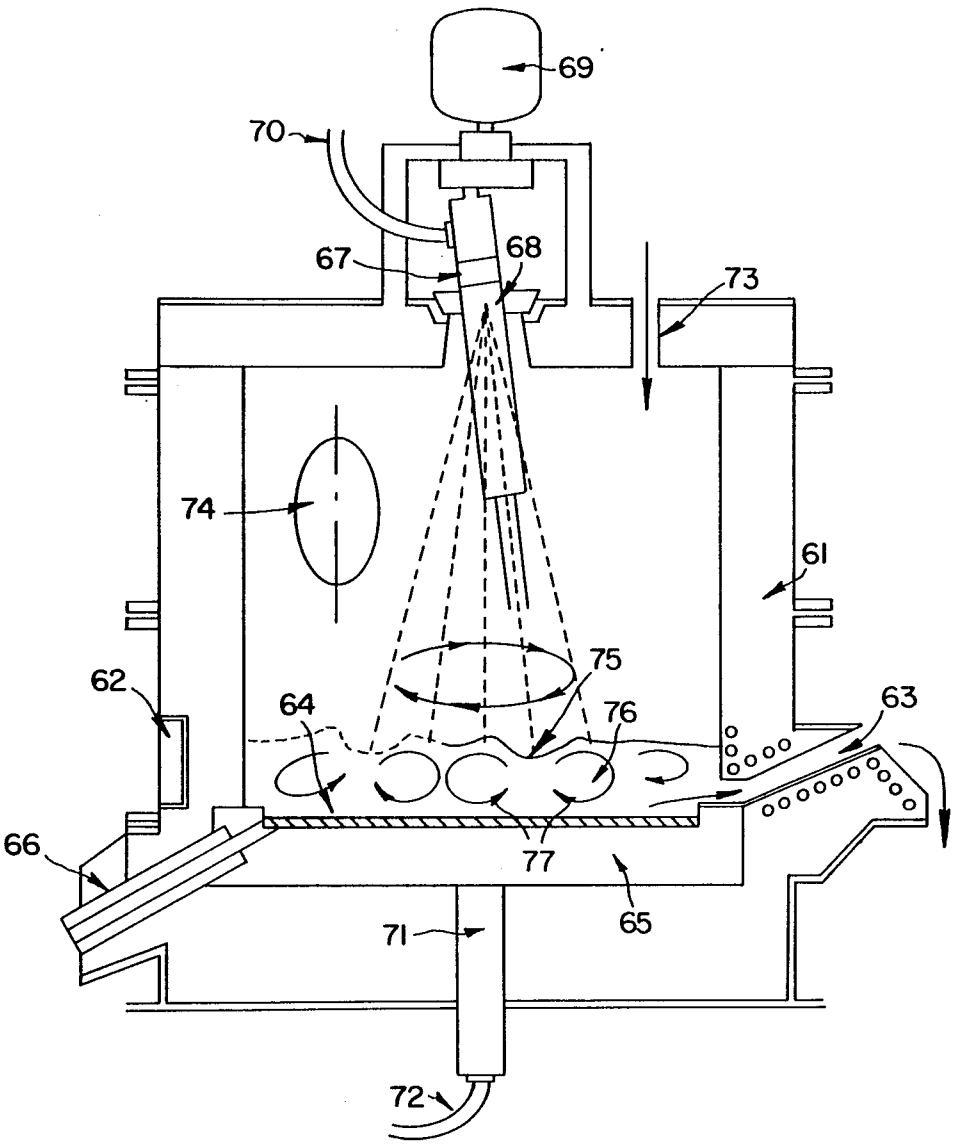
FIG. 6 is a cross-sectional view of a plasma arc furnace adapted to practice of the present invention.

The construction of the high intensity heating furnace for use with PGM feedstock containing chromite should be such that uncontrolled amounts of carbon or carbonaceous materials do not come in contact with any chromite present in the feed to the furnace since the resultant ferrochrome which may form, as earlier noted, seriously impairs the recovery of platinum group metals. Thus either no carbon should be present in the furnace refractory lining or construction, or, if present, should be suitably protected against the possibility of contact with chromite at high temperatures above about 1100° C. This can be achieved, as shown in FIG. 6, by using suitable non-carbonaceous refractories for crucible 65 and extending the anode 71 to make contact with the collector metal layer 64.

The presence of a small amount of carbon or sulphur in the feed to the furnace has been found beneficial in obtaining good recovery of collector metal and platinum group metals. The effect of carbon or sulphur, termed activators, is to scavenge residual oxygen in the feed powders and ensure a neutral or slightly reducing atmosphere in the furnace. The amount of carbon or sulphur found useful for this purpose is between about 0.5 and 3.0% by dry weight of platinum group metal containing feedstock materials admitted to the furnaces.

In the process of the present invention, high intensity heating is performed in the presence of one or more metals which have been found to be efficient collectors for the platinum group metals. The term 'collector material' as used herein includes copper, nickel, cobalt, and iron, metals or mixtures thereof or any other suitable metal to which platinum group metals will report during a smelting process as well as compounds that are reducible to collector metal under process conditions. Additionally, the collector material(s) should be chosen such that the eventual recovery of platinum group metals therefrom is not exceptionally difficult or uneconomical.

Some of the collector metals as noted above may also be admitted to the furnace in the form of their oxides or hydroxides or other compounds if they are suitable for reduction to metal in the furnace with reductants, e.g. carbonaceous material. Although the adverse effect of carbon on reduction of chromite in the smelting process has previously been described as an example of the process, careful control of the amount of reductant carbonaceous material, introduced with the feed may ensure that there is no carbonaceous material after the preferential reduction of the collector metal oxides, hydroxides, or other compounds.

Typically, the collector material will be present in an amount between about 3% to about 10% by dry weight of the platinum group metal-containing flotation concentrates and slimes admitted to the furnace. Similar quantities are useful with other feedstock materials. For a concentrate produced from a South African ore which contains about 5% chromite in the feed to the furnace, 3% copper or iron powder or 5% hematite iron ore fines with appropriate carbonaceous reductant may be used.

The collector metals may be introduced into the furnace either by mixing them with the feedstock prior to entry to the furnace or by separately melting these materials, either inside or outside the furnace, to provide a liquid layer thereof in the furnace prior to introduction of the feedstock.

Fluxes may also be added to the feedstock material to control or alter the viscosity, melting temperature and basicity of the resultant slag layer. It may be convenient in industrial practice to continuously feed platinum group metal containing feedstock materials to the furnace with added collector material and to gradually reduce the quantity of added collector material so that the collector material liquid layer in the furnace becomes continually enriched with platinum group metals to a concentration particularly suited for further treatment of collector material/PGM layer for recovery of platinum group metals.

Fluxes may also be added to the smelting furnace to control or alter the viscosity, melting temperature and basicity of the resultant slag layer. Suitable flux materials, for example, are lime and dolomite. A typical slag has a melting point in the range of about 1100° C. to about 300° C. In addition, other minerals may form, such as magnesio-chromite. It is important to obtain a low slag viscosity in order to achieve rapid mixing and efficient separation of the small particles of platinum group metals and collector metals.

Upon separation into fluid slag and metal layers within the high intensity heating furnace, the slag layer is tapped and further processed for disposal as shown in FIG. 2. Depending upon the efficiency and economics of the overall process, it may, in some instances be desirable to granulate at 11 and grind the slag at 13 then concentrate small particles of platinum group metals and collector material from slag by gravity separation techniques at 14 and remelt them with platinum group metal concentrates with appropriate collectors to recover the residual platinum group metals therein as shown in FIG. 2 or else send the particles to leaching 16 with the metallic layer from the furnace.

The metallic layer, containing the metal collector in association with the substantial portion of the platinum group metals, is then removed from the furnace and further processed to recover the platinum group metals or mixtures thereof. For example, in FIG. 3, the metal layer may be granulated at 36 and then subjected to acid leaching at 37 whereby the metal layer is dissolved in acids such as sulfuric, hydrochloric or mixtures thereof, and the platinum group metals precipitate and/or form colloids and are separated by filtration as an insoluble sludge.

Alternatively, the metallic layer from the furnace may be cast into plates and treated directly by electrolysis to remove collector material and leave a platinum group metal-containing sludge. In either case, the platinum group metal-containing sludge(s) from processing of the metallic layer are then treated in a known manner to recover either a single metal or metals or a mixture thereof.

FIG. 6 illustrates a plasma arc furnace adapted to practice of the present invention. In FIG. 6, a jet of ionised gas, i.e. plasma flame, flowing from the tip of the plasma torch 68 towards the slag layer impinges on the slag layer and superheats the slag at the impingement zone. The temperature of the plasma gas may be at about 5,000°–10,000° C. depending on the amount of entrainment of the surrounding furnace atmosphere which is at a temperature of about 1500°–2000° C. The position of the impinging flame is adjusted to cause a superheated puddle 75 at the surface of the molten slag layer 76. The formation and size of the super heated puddle 75 is dependent the upon plasma gas temperature, flowrate, pressure, and distance from the tip of the torch to the surface of the slag layer. The impingement of the plasma flame on the surface of the slag layer when properly adjusted for the process of the present invention causes a noticeable depression in the surface. The region of slag surrounding the puddle is subject to vigorous flow circulation pattern such as shown by the curved arrows 77 in FIG. 6, due to the very low viscosity of the slag in the high temperature flame impingement zone (superheated puddle) and the physical displacement of slag by the flame. In the embodiment shown, the precessive movement of the plasma torch causes the formation of a "doughnut" shaped zone of high temperature slag which is believed to be responsible for the very effective mixing which occurs in the slag layer. The depth of the slag layer is preferably selected so that the depth to diameter ratio is between about 1 to 5 and 1 to 10 and the residence time of the slag based on volumetric flow rate does not exceed 20 minutes. The very fine micron and sub-micron sized PGM particles in the feedstock are rapidly agglomerated by physical contact in the circulatory motion of the fluid slag in the puddle and rapidly associated with the collector material. The hitherto unexpected effectiveness of this "puddle circulation" effect is shown by PGM recoveries in collector material in the range of 90–95% which may be achieved in an average slag residence time less than about 20 minutes compared with several hours required for conventional submerged electric arc furnaces.

With reference to FIG. 6, the plasma arc smelting furnace consists of a circular steel shell made in several sections for convenience and lined with refractories 61 suitable for the high process temperatures and having good chemical resistance to attack by the slag, fluxes and feedstock, e.g. high alumina refractories. At the slag layer zone, a water cooled panel 62 is used to form a frozen layer of slag on the refractory lining 61 to protect it from attack by the slag. A water-cooled slag overflow spout 63 permits the slag to leave the furnace continuously after flowing in close proximity to the PGM-collector material layer 64. The PGM collector metal layer accumulates in an electrically conductive crucible 65 e.g. manufactured from graphite. The collector metal associated with PGM's is tapped intermittently from the furnace through taphole 66. The plasma arc torch 67 shown in FIG. 6 is of the variable length expanded precessive arc type manufactured by Tetronics Research and Development Co., Ltd. described above. This plasma torch is precessed about bearing 68 by motor 69 and describes a cone of revolution. The distance from the lower tip of the torch to the surface of the slag layer and the angle of precession from the vertical axis of the furnace can both be adjusted. The rate of movement of the plasma arc across the slag surface is selected to give a substantially uniform puddle temperature and is typically about 500 to 1500 feet per minute. For example, in a plasma arc furnace where the length of the plasma flame (distance between the plasma torch and slag surface) is about 10–20 inches and the angle of the flame precession is up to about 10° from vertical the preferred rate of movement for the flame on the slag surface is about 1000 feet per minute. Electricity is supplied to the torch through cable 70 and the anode 71 is connected to the crucible 65 and cable 72 back to a power supply. Feedstock material enters the furnace through several feed tubes 73 (others omitted for clarity) and waste gases leave the furnace through exhaust port 74. In certain instances, it is desirable to position feed tubes 73 so as to direct the feedstock material directly into the plasma arc for rapid melting thereof. It will be appreciated by those skilled in the art that the process described in the foregoing paragraph is equivalent to that described in connection with FIGS. 1, 2 and 3 except that the feed enters the process at the steps identified by reference numerals 8, 11, and 35, respectively in those Figures.

The process of the present invention is further illustrated by the following non-limiting examples.

EXAMPLE ONE

Chromite-bearing ore containing approximately 5 grams per tonne of platinum group metals was comminuted, and subjected to wet high intensity magnetic separation using a Jones Ferromagnetics Separator with two passes of nonmagnetics. Assays for platinum and palladium are presented as these represent approximately 50% and 25% respectively of the platinum group metal content of the particular ore.

| | Assays | | | | Recoveries % | | |
|---|---|---|---|---|---|---|---|
| Product | wt % | $Cr_2O_3$ % | Pt g/t | Pd g/t | $Cr_2O_3$ | Pt | Pd |
| magnetics pass 1 | 62.2 | 39.27 | 1.1 | 0.5 | 80.3 | 21.9 | 20.4 |
| magnetics pass 2 | 14.1 | 33.27 | 2.7 | 1.2 | 15.4 | 12.2 | 11.1 |
| magnetics 1 + 2 | | | | | | | |
| nonmagnetics pass 2 | 76.3 | 38.17 | 1.4 | 0.6 | 95.7 | 34.1 | 31.5 |
| pass 2 | 23.7 | 5.47 | 8.7 | 4.4 | 4.3 | 65.9 | 68.5 |
| calc. head assay | 100.0 | 30.41 | 3.1 | 1.5 | — | | |
| actual head assay | — | 30.70 | 3.1 | 1.6 | — | | |

The slurry pulp density was 30% solids (wt.) to the first pass and 20% solids (wt.) to the second pass. The magnetic field strength was 1.0 tesla for both passes.

EXAMPLE TWO

Figure 4:
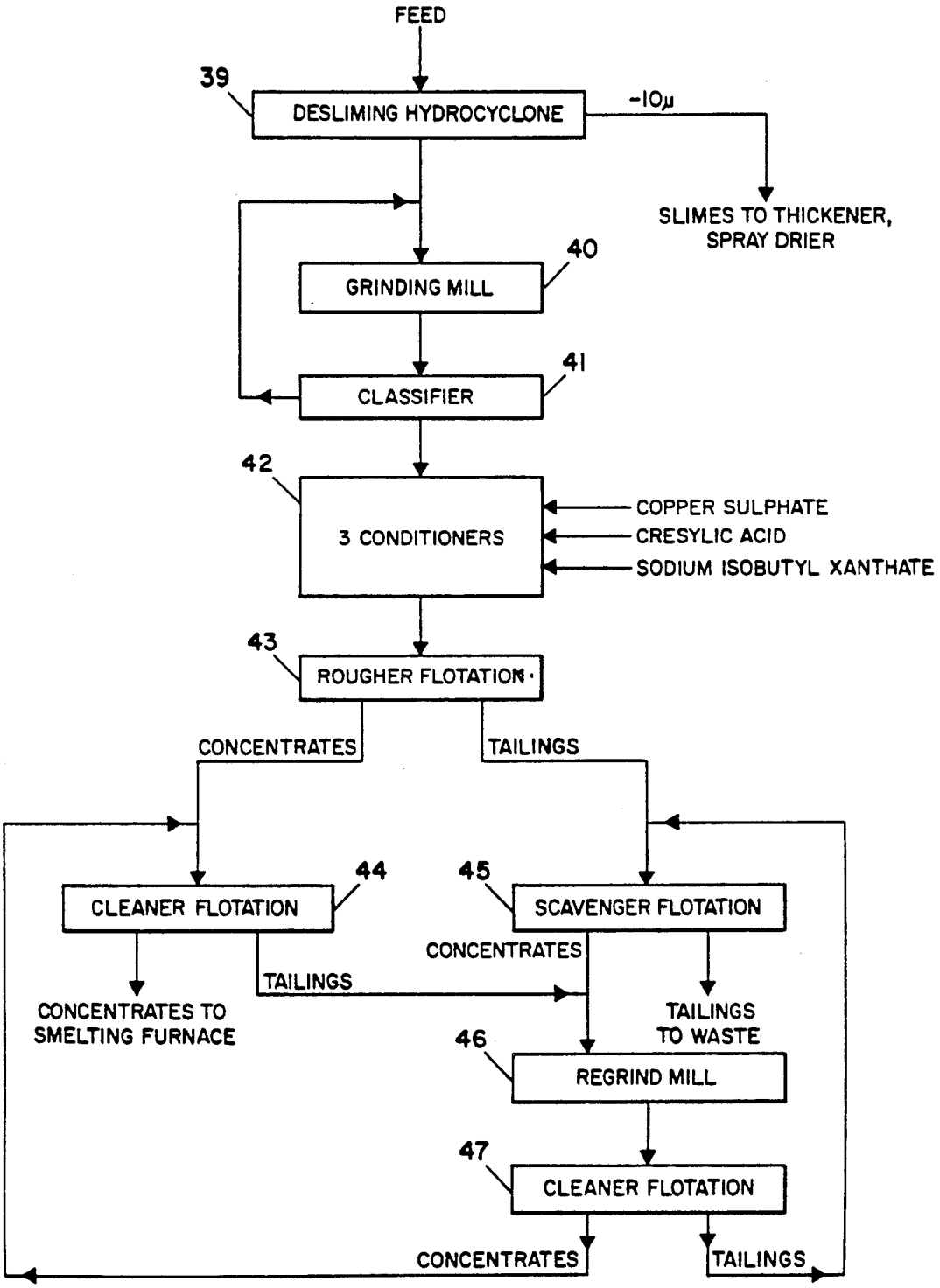
FIG. 4 is a schematic flowsheet of the flotation upgrading system described in Example Two.

Nonmagnetics produced by wet high intensity magnetic separation were processed in a pilot flotation plant according to the flowsheet shown in FIG. 4. The feed ore was deslimed at 39 at 10 microns and the deslimed ore was ground at 40 to 80% minus 200 mesh ASTM using a classifier at 41 consisting of a hydrocyclone and screen in closed circuit with the mill. The ground ore was adjusted to a pulp density of approximately 50% solids and conditioner reagents were added to three stirred conditioner tanks, 42, in series. The conditioning times were 10 minutes with 100 grams per ton of copper sulphate (hydrated basis), 4 minutes with 100 grams per ton of sodium isobutyl xanthate. The conditioned pulp was diluted to 30% solids by weight at a pH of 8.5 and was sent to rougher flotation cells 43 for 15 minutes of flotation. The concentrates from rougher flotation were sent to cleaner flotation cells 44 for 10 minutes of flotation. The tailings from the rougher flotation were sent to scavenger flotation cells 45 for 25 minutes of flotation and the tailings from scavenger flotation were discharged as waste. The concentrates from scavenger flotation were sent to a regrind mill 46 together with tailings from the cleaner flotation cells 47 for 10 minutes flotation. The concentrates from cleaner flotation cells 47 were sent to comingle with the concentrates from rougher flotation cells 43 before being sent to cleaner flotation cells 44. The tailings from cleaner flotation cells 47 were sent to comingle with the tailings from rougher flotation cells 43 before being sent to the scavenger flotation cells 45. The concentrates from cleaner flotation cells 44 were final concentrates and were filtered and dried before mixing with the slimes produced from desliming hydrocyclone 39.

| | Assays | | | Distribution % | |
|---|---|---|---|---|---|
| Product | wt % | Pt g/t | Pd g/t | Pt | Pd |
| DESLIMING HYDROCYCLONE | | | | | |
| underflow | 82.3 | 8.9 | 4.1 | 85.2 | 84.5 |
| overflow | 17.7 | 7.2 | 3.5 | 14.8 | 15.5 |
| head | 100.0 | 8.6 | 4.0 | 100.0 | 100.0 |
| FLOTATION OF DESLIMED NONMAGNETICS | | | | | |
| concentrates | 14.5 | 47.0 | 23.9 | 79.2 | 80.2 |
| tailings | 85.5 | 2.1 | 1.0 | 20.8 | 19.8 |
| calc. head | 100.0 | 8.6 | 4.3 | 100.0 | 100.0 |
| assayed feed | | 8.8 | 4.2 | | |

EXAMPLE THREE p

Flotation concentrates containing 32 grams/ton platinum, 17.5 grams/ton palladium and 7.8% $Cr_2O_3$ were mixed with lime, copper powder and carbon in the weight proportions 72/19/7.5/1.5 and heated in a high intensity gas fired furnace at 1500° C. A metal phase was separated from a slag phase and the weight distribution and assays of the products were as follows:

| | Assays | | | Distribution % | |
|---|---|---|---|---|---|
| Product | wt % | Pt g/tonne | Pd g/tonne | Pt | Pd |
| metal | 2.77 | 260 | 115 | 46.0 | 45.0 |
| slag | 97.23 | 8.7 | 4.0 | 54.0 | 55.0 |
| calc. head | 100.00 | 15.7 | 7.1 | 100.0 | 100.0 |

EXAMPLE FOUR

Flotation concentrates containing 32 grams/ton platinum, 17.5 grams/ton palladium and 7.8% $Cr_2O_3$ were mixed with lime, ferric oxide and carbon in the weight proportions 74/20/4/2 and heated in a high intensity gas fired furnace at 1500° C. A metal phase was separated from a slag phase and the weight distribution and assays of the products were as follows:

| | Assays | | | Distribution % | |
|---|---|---|---|---|---|
| Product | wt % | Pt g/tonne | Pd g/tonne | Pt | Pd |
| metal | 1.27 | 432 | 209 | 48.5 | 32.5 |
| slag | 98.73 | 5.9 | 5.6 | 51.5 | 67.5 |
| calc. head | 100.00 | 21.3 | 15.4 | 100.0 | 100.0 |

EXAMPLE FIVE

Figure 5:
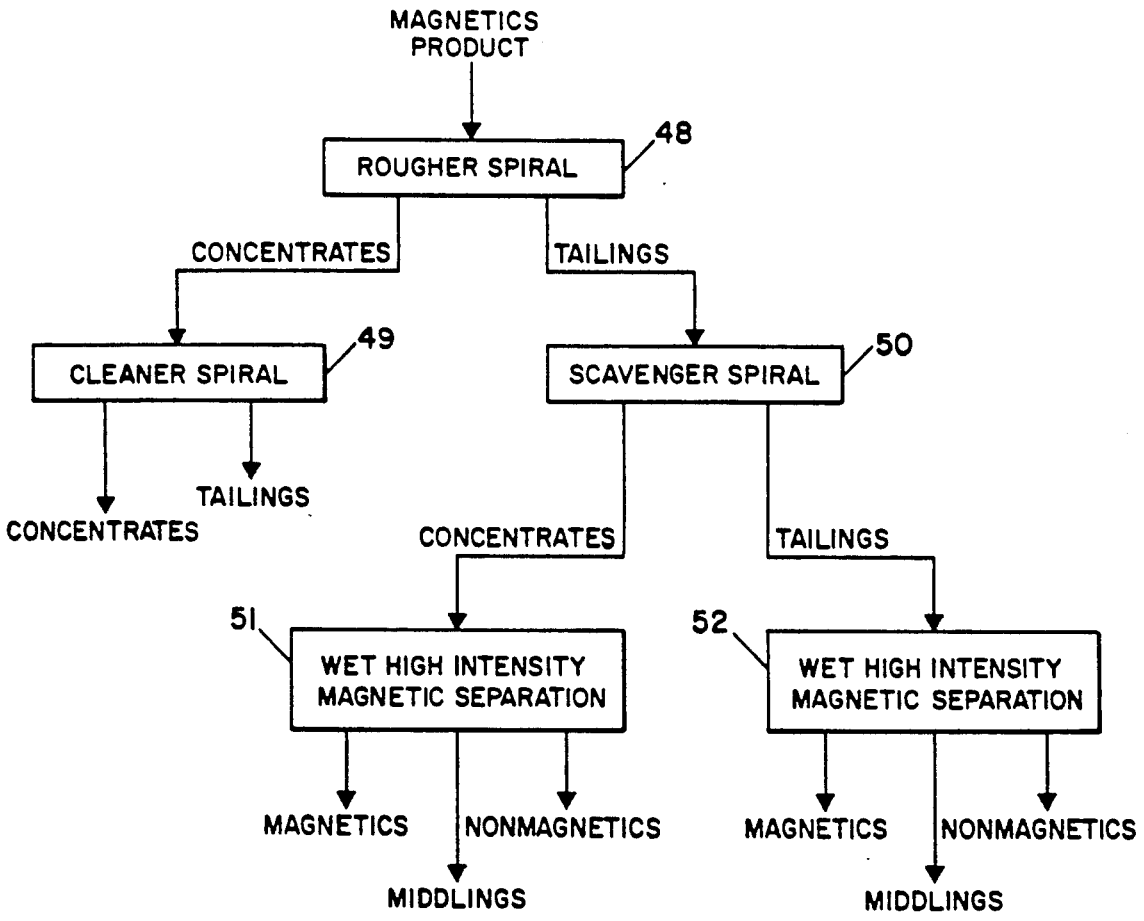
FIG. 5. is a schematic flowsheet of the spirals upgrading and wet high intensity magnetic separation described in Example 5.

Magnetics produced by wet high intensity magnetic separation of a South African ore in a pilot plant were processed on a batch basis by spirals and wet high intensity magnetic separator according to the flowsheet shown in FIG. 5. The magnetics product was fed to Rougher Spiral 48 at a feedrate of 1.2 tons per hour and about 35% solids by weight and the concentrates were fed to the Cleaner Spiral 49 to produce two products, concentrates and tailings. The mass and assay balances for the Rougher and Cleaner Spirals are as follows:

| Product | wt % | Assays $Cr_2O_3$ % | Pt g/tonne | Pd g/tonne | Recoveries % $Cr_2O_3$ | Pt | Pd |
|---|---|---|---|---|---|---|---|
| ROUGHER SPIRAL | | | | | | | |
| concentrate | 76.4 | 40.49 | 0.6 | 0.3 | 82.1 | 43.7 | 44.7 |
| tailings | 23.6 | 28.59 | 2.5 | 1.2 | 17.9 | 56.3 | 55.3 |
| calculated head | 100.0 | 37.68 | 1.05 | 0.51 | 100.0 | 100.0 | 100.0 |
| assayed head | | 37.65 | 1.4 | 0.5 | | | |
| CLEANER SPIRAL | | | | | | | |
| concentrate | 89.1 | 41.97 | 0.6 | 0.3 | 92.0 | 66.2 | 69.0 |
| tailings | 10.9 | 29.71 | 2.5 | 1.1 | 8.0 | 33.8 | 31.0 |
| calculated head | 100.0 | 40.63 | 0.81 | 0.39 | 100.0 | 100.0 | 100.0 |
| assayed head | | 40.49 | 0.6 | 0.3 | | | |

In FIG. 3, the tailings from the Cleaner Spiral are comingled with the tailings from the Rougher Spiral and reground at 25 before separation on the scavenger Spiral. The assays tabulated above can be combined to indicate the grade and recovery of the chromite concentrate and the feed to the Scavenger Spiral 26 in FIG. 3.

| Product | wt % | Assays $Cr_2O_3$ % | Pt g/tonne | Pd g/tonne | Recoveries % $Cr_2O_3$ | Pt | Pd |
|---|---|---|---|---|---|---|---|
| ROUGHER - CLEANER SPIRAL | | | | | | | |
| concentrate | 68.1 | 41.97 | 0.6 | 0.3 | 75.6 | 33.9 | 35.3 |
| tailings | 31.9 | 28.88 | 2.5 | 1.2 | 24.4 | 66.1 | 64.7 |
| calculated head | 100.0 | 37.79 | 1.2 | 0.6 | 100.0 | 100.0 | 100.0 |
| assayed head | | 37.65 | 1.4 | 0.5 | | | |

The tailings produced for Rougher Spiral 48 in FIG. 5 was fed to a Scavenger Spiral 50 without regrind and the mass and assays of the products are tabled below.

| Product | wt % | Assays $Cr_2O_3$ % | Pt g/tonne | Pd g/tonne | Recoveries % $Cr_2O_3$ | Pt | Pd |
|---|---|---|---|---|---|---|---|
| SCAVENGER SPIRALS | | | | | | | |
| concentrate | 49.2 | 25.83 | 2.6 | 1.2 | 44.8 | 50.2 | 49.2 |
| tailings | 50.8 | 30.84 | 2.5 | 1.2 | 55.2 | 49.8 | 50.8 |
| calculated head | 100.0 | 28.38 | 2.5 | 1.2 | 100.0 | 100.0 | 100.0 |
| assayed head | | 28.59 | 2.5 | 1.2 | | | |

These results show that regrind of the scavenger feed is essential for liberation of chromite and platinum group metals from composite particles.

The two products from the Scavenger Spiral 50 were subjected to laboratory scale wet high intensity magnetic separation at a field strength of 1.5 tesla. The effect of regrinding was tested by grinding the spirals concentrate to 100% minus 80 microns and the spirals tailings was separated at the same conditions but without regrinding.

| Product | wt % | Assays $Cr_2O_3$ % | Pt g/tonne | Pd g/tonne | Recoveries % $Cr_2O_3$ | Pt | Pd |
|---|---|---|---|---|---|---|---|
| SCAVENGER SPIRALS CONCENTRATES AFTER REGRIND | | | | | | | |
| magnetic | 66.3 | 35.35 | 1.1 | 0.6 | 82.6 | 27.7 | 32.7 |
| middlings | 3.0 | 12.91 | 6.0 | 2.7 | 1.4 | 6.8 | 6.7 |
| tailings | 30.7 | 14.85 | 5.6 | 2.4 | 16.1 | 65.4 | 60.6 |
| calculated head | 100.0 | 28.38 | 2.6 | 1.2 | 100.0 | 100.0 | 100.0 |
| SCAVENGER SPIRALS CONCENTRATES WITHOUT REGRIND | | | | | | | |
| magnetic | 71.1 | 34.96 | 2.0 | 0.9 | 81.2 | 48.3 | 47.4 |
| middlings | 3.5 | 21.55 | n.a* | n.a* | 2.5 | — | — |
| tailings | 25.4 | 19.71 | 6.0 | 2.8 | 16.4 | 51.7 | 52.6 |
| calculated head | 100.0 | 30.62 | 3.6 | 1.4 | 100.0 | 100.0 | 100.0 |

*n.a. insufficient sample for assay

From these results, the advantages of regrinding the feed to the Scavenger Spiral may be clearly seen. In addition, it may be seen that additional recovery of chromite and platinum group metals is possible by processing the scavenger products by wet high intensity magnetic separation as shown at 22 in FIG. 3.

EXAMPLE SIX

Flotation concentrates containing 55 grams/ton platinum and 28 grams/ton palladium and 5.9% $Cr_2O_3$ were mixed with lime, copper powder and charred coal containing 70% fixed carbon in weight proportions 70/25/2/3. The mixture was fed into a plasma arc furnace which contained a molten layer of 20 kilograms of copper metal. The furnace temperature was maintained at 1500°-1600° C. during the feeding of the mixture by controlling the electrical energy input and feedrate. At the conclusion of feeding 80 kilograms of the mixture the furnace was maintained at a temperature of 1550°-1650° C. for 30 minutes and then the slag and metal in the furnace were poured into ladles. After cooling the copper metal was separated from the slag and the platinum group metal was separated from the copper.

| | Component Mass Balance | | | | | | | | | |
|---|---|---|---|---|---|---|---|---|---|---|
| | wt kg. | Pt g/tonne | grams | dist. % | Pd g/tonne | grams | dist % | Cr % | kg. | dist. % |
| feed | 80.0 | 27.7 | 2.2160 | — | 12.9 | 1.0320 | — | 2.07 | 1.6560 | — |
| metal | 21.5 | 108 | 2.3220 | 97.7 | 46.0 | 0.9890 | 97.3 | 0.02 | 0.0043 | 0.2 |
| slag | 69.3 | 0.8 | 0.0554 | 2.3 | 0.4 | 0.0277 | 2.7 | 2.57 | 1.7810 | 99.8 |
| | | | 2.3774 | | | 1.0167 | | | 1.7853 | |
| Accountability | | | 107.3% | | | 98.5% | | | 107.8% | |

EXAMPLE 7

A plasma arc furnace having a shell diameter of 1.5 meters, and a 1.0 meter internal diameter, and equipped with a variable length exanded precessive plasma arc torch was used to process 21.5 tons of alumina pellets, containing about 380 g/tone on platinum and 200 g/ton on palladium, for recovery of the platinum group metals in an iron collector metal layer. Lime was used as a flux and iron oxide (millscale) and carbon (coal) were added to the feed mixture to generate iron collector metal to supplement the initial layer of 45 kg. of molten cast iron and to maintain a reducing atmosphere inside the furnace. During the test approximately 350 kg. of the refractory lining of the furnace was dissolved by slag attack. The components in the feed were blended in a ribbon blender prior to introduction to the furnace through four feedholes in the furnace roof equally spaced around the plasma torch so that the feedstock dropped into the vicinity of a doughnut shaped superheated puddle of slag produced by the impingement of the ionized argon gas plasma flame on the surface of the slag layer. The proportions of components in the feed mixture were as follows:

| | |
|---|---|
| pellets | 48.7 |
| lime | 48.7 |
| iron oxide | 0.2 |
| coal | 2.4 |
| | 100.0 |

The feed mixture was processed at a feed rate averaging about 700 kg/hour and at rates up to 1000 kg/hour with an average slag layer temperature of about 1400° C. The temperature of the superheated slag in the superheated puddle was not measured but the extremely fluid condition in the puddle could be observed through an observation port in the side of the furnace. The slag continuously overflowed from the furnace during the test. Regular samples of slag were automatically collected from the slag stream discharging from the furnace for assay purposes. The waste gas from the furnace passed through a solids dropout chamber and a combustion chamber was provided for CO and $H_2$ gases evolved from the coal and oxide reduction reactions in the furnace, baghouse and, exhaust fan, and stack. The dropout material and baghouse dust were collected and sampled for assay. The waste gas was assayed on an intermittent basis. Zircon sand (20 kg.) was used in several experiments as a tracer material to determine the residence time of slag in the furnace. The peak in zirconia content of the slag occurred 5–6 minutes after injection into the feed holes indicating a very short residence time for the majority of the slag. At the conclusion of the test the collector metal taphole was opened and the metal and slag remaining in the furnace were removed, sampled and assayed. Typical assays (wt %) of the feed materials and products are tabled below.

| | Feed Mix % | Slag Product % | Baghouse Dust % | Dropout Material % |
|---|---|---|---|---|
| $SiO_2$ | 0.4 | 0.6 | 0.5 | 0.8 |
| $Al_2O_3$ | 48.1 | 47.10 | 3.2 | 22.8 |
| MgO | 0.3 | 0.4 | 0.2 | 0.3 |
| CaO | 46.6 | 51.1 | 20.0 | 72.2 |
| $Fe_2O_3$ | 0.3 | 0.3 | 0.4 | 0.6 |
| PbO | 2.8 | <0.01 | 68.6 | 2.0 |
| Loss on Ignition | 9.0 | (1.1) | 0.3 | 2.4 |
| Pt | 0.0484* | 0.0011 | 0.013 | 0.0150 |
| Pd | 0.0188* | 0.0004 | 0.0211 | 0.0104 |

| Collector Metal % | | | | | | | |
|---|---|---|---|---|---|---|---|
| C | Si | Cr | Ni | Cu | Fe | Pt | Pd |
| 3.7 | 0.08 | 7.8 | 0.5 | 0.6 | 76.3 | 3.87 | 1.42 |

*Assay of catalyst in the feed mix.

The PGM and other major component material balances for the test were as follows:

| Inputs | | | |
|---|---|---|---|
| PGM | | Other Components | |
| Pt | 7.99 kg | $Al_2O_3$ | 17,773 kg |
| Pd | 4.20 | CaO | 20,331 |
| Total | 12.19 | | |

| Outputs | | | | | | |
|---|---|---|---|---|---|---|
| Slag | Baghouse Dust | Dropout | Material | Refractory | Metal | Total |
| PGM | | | | | | |
| Pt | 0.410 | 0.226 | 0.0985 | 0.0874 | 6.76 | 7.58 |
| Pd | 0.156 | 0.340 | 0.0794 | 0.0305 | 2.46 | 3.06 |
| Total | 0.566 | 0.566 | 0.1799 | 0.1179 | 9.22 | 10.64 |
| Other Components | | | | | | |
| $Al_2O_3$ | 17,930 | 59 | 116 | 203 | — | 18,308 |
| CaO | 19,021 | 323 | 455 | 288 | — | 20,087 |

| Overall Balance | | | | |
|---|---|---|---|---|
| | Output | Input | Out-in | Accountability % |
| Pt | 7.58 | 7.99 | (0.41) | 94.9 |
| Pd | 3.06 | 4.20 | (1.14) | 72.9 |
| Total | 10.64 | 12.19 | (1.55) | 87.3 |
| $Al_2O_3$ | 18,308 | 17,773 | 535 | 103.0 |
| CaO | 20,087 | 20,331 | (244) | 98.8 |

The recoveries of PGM in various test products were as follows:

| | Basis: | | | |
|---|---|---|---|---|
| | Input | | Output | |
| Product | Pt | Pd | Pt | Pd |
| slag | 5.1 | 3.7 | 5.4 | 5.1 |
| baghouse dust | 2.8 | 8.1 | 3.0 | 11.0 |
| dropout material | 1.2 | 1.9 | 1.3 | 2.6 |
| refractory | 1.1 | 0.7 | 1.1 | 1.0 |
| metal | 84.6 | 58.6 | 89.2 | 80.3 |
| | 94.8 | 73.0 | 100.0 | 100.0 |

The PGM in the dropout material and refractory may be recycled to the furnace in commercial practice if desired. Also, the PGM in the baghouse dust may be recovered by conventional precious metal lead blast furnace practice. It is believed that the reasons for the high palladium losses to the baghouse dust was oxidation in the furnace due to excess oxygen.

What is claimed:

1. A process for recovering platinum group metals from feedstock materials including such metals, in a plasma arc furnace which comprises the steps of:

introducing a charge of flux, a collector material, and a feedstock material to the plasma furnace;

forming a melt by heating the charge to at least about 1350° C., the melt comprising a first layer of slag and a second layer of collector material associated with a major portion of the platinum group metals from the feedstock material; and impinging a plasma arc flame on a surface on a surface of the slag layer so that a superheated puddle is formed on said surface having a temperature of about 100° to 500° C. greater than the melt, and which fluid and thermal flow in the superheated puddle and slag whereby the accumulation of platinum group metals in the second layer is accelerated and the plasma arc flame is moved across the slag layer surface to distribute heat in the superheated puddle and avoid vaporization of the slag.

2. The process recited in claim 1, further comprising the step of:

providing a continuous supply of said flux, collector material and feedstock material to said plasma furnace so that said process can be operated on a continuous basis.

3. The process recited in claim 1, wherein:

more than about 90% of the platinum group metals in the feedstock material accumulates in the second layer in less than about twenty minutes after the feedstock material enters the furnace.

4. The process in claim 3, further comprising the step of:

providing a continuous supply of said flux, collector material and feedstock material to said plasma furnace so that said process can be operated on a continuous basis.

* * * * *